US006095859A

United States Patent [19]

Maeda

[11] Patent Number: 6,095,859

[45] Date of Patent: Aug. 1, 2000

[54] WATER-PROOF CONNECTOR

[75] Inventor: Akira Maeda, Shizuoka, Japan

[73] Assignee: Yazaki Corporation, Tokyo, Japan

[21] Appl. No.: 09/356,519

[22] Filed: Jul. 19, 1999

[30] Foreign Application Priority Data

Jul. 23, 1998 [JP] Japan ..... 10-208211

[51] Int. Cl.[7] ..... H01R 13/40

[52] U.S. Cl. ..... 439/587

[58] Field of Search ..... 439/587, 588, 439/589, 274, 275, 271, 283, 276

[56] References Cited

U.S. PATENT DOCUMENTS

| | | | |
|---|---|---|---|
| 4,950,175 | 8/1990 | Plyler et al. | 439/274 |
| 5,194,012 | 3/1993 | Cairns | 439/201 |
| 5,529,508 | 6/1996 | Chiotis et al. | 439/204 |

FOREIGN PATENT DOCUMENTS

| | | | |
|---|---|---|---|
| 64-63282 | 3/1989 | Japan | H01R 13/52 |

*Primary Examiner*—Gary F. Paumen
*Assistant Examiner*—Truc Nguyen
*Attorney, Agent, or Firm*—Sughrue, Mion, Zinn, Macpeak & Seas, PLLC

[57] ABSTRACT

The connector structure is structured such that a plurality of terminal storage chambers respectively formed within a housing 31 are in communication with the outside through their associated terminal insertion passages 59, a gel 47 interposed between the terminal storage chambers and terminal insertion passages 59 is disposed within the housing 31, a plurality of terminals respectively connected to the leading ends of their associated electric wires can be respectively mounted within their associated terminal storage chambers in such a manner that they are inserted from their associated terminal insertion passages 59 and made to pass through the gel 47, and the gel 47 seals off spaces between the housing 31 and electric wires. In the terminal insertion passages 59, there are respectively disposed leader bodies 65 which are so held at the leading ends of their associated terminals as to be able to pass through the gel 47 and also which, after they have passed through the gel 47, can be discharged to the outside from their associated terminal storage chambers.

4 Claims, 4 Drawing Sheets

WATER-PROOF CONNECTOR

BACKGROUND OF THE INVENTION

1. Field of invention

The present invention relates to a waterproof connector including a waterproof gel through which a terminal is made to pass and, in particular, to a waterproof connector which, when a terminal is made to pass through a gel, can prevent the cutoff gel from sticking to the connecting portion of the terminal.

2. Related Art

Conventionally, as means for sealing off a space between a housing of a connector and a terminal to be guided from the housing, there is sometimes used grease. However, in the grease, there are found some drawbacks to be improved. In particular, the grease will lower in viscosity at high temperatures and thus can flow out of the sealing space to thereby unstabilize the sealed state of the sealing space. Also, once used, the grease becomes difficult to remove, which makes it difficult to inspect and repair the connector.

Further, in this type of sealing structure, instead of the grease, there is sometimes used epoxy-system adhesive. In this case, it is true that a highly reliable sealing structure can be realized, but, after the adhesive is hardened, reuse of the adhesive, especially, reinsertion of the adhesive is difficult.

As a waterproof connector which can eliminate the above drawbacks, for example, there is known a waterproof connector which is disclosed in Japanese Patent Publication Sho.64-63282. Referring here to this waterproof connector, as shown in FIG. 7, the waterproof connector includes a square-frame-shaped rear holder 1 opened on the mutually opposing surfaces thereof which are arranged in parallel to each other; and, on the inner periphery of one opening 3 of the rear holder 1, there is projectingly provided a frame-shaped stopper 5. A plate-shaped base 7 is inserted into the rear holder 1. In particular, the base 7 is stored within the rear holder 1 in such a manner that it is contacted with the stopper 5 and is thereby prevented against removal from one opening 3. In the base 7, there are opened up a plurality of terminal pass-through holes 8 in a lattice manner.

Into the rear holder 1 with the base 7 stored therein, there is inserted a plate-shaped mat seal member (gel) 13 from the other opening 11 thereof. As shown in FIG. 8, the gel 13 is held by a hold projection 15 provided within the rear holder 1 in such a manner that the outer periphery of the gel 13 is in close contact with the inner peripheral surface of the rear holder 1 and one surface of the gel 13 is in close contact with the back surface of the base 7. As shown in FIG. 9, the rear holder 1 is structured such that the other opening 11 thereof can be fitted with the rear portion of a housing 17. In the rear portion of the housing 17, there is opened up a terminal mounting insertion opening 19 which is in communication with a terminal storage chamber. The terminal mounting insertion opening 19 is in alignment with the terminal through hole 9. That is, the terminal mounting insertion opening 19 and terminal through hole 9 are interrupted by the gel 13 which is interposed between them.

To insert a terminal 23 into the thus assembled connector, the terminal 23 with an electric wire 21 connected thereto may be inserted into the terminal pass-through hole 9 of the base 7 from the surface of the rear holder 1 on which side the base 7 is exposed. The terminal 23 passes through the gel 13 while thrusting through the same, and is then mounted into its corresponding terminal storage chamber formed within the housing 17. As a result of this, the outer periphery of the electric wire 21, which has passed through the gel 13, is closely contacted with the gel 13 to thereby be able to seal off the space between the electric wire 21 and housing 17.

According to the above-mentioned waterproof connector, not only there can be prevented the flow-away of the grease caused by the high temperatures, but also there is possible the re-insertion of the terminal which is impossible in the previously-mentioned conventional connector using the epoxy-system adhesive.

However, in the above-mentioned conventional connector structure, if an electric contact portion 23*a* to be formed in a terminal, for example, as shown in FIG. 10, is formed in a prismatic shape and the leading end thereof is opened on a plane 23*b* which intersects at right angles to the axis of the electric contact portion 23*a*, then there is a possibility that, when the terminal passes through the gel while thrusting the same, part of the gel can be cut out to stick to the interior portion of the electric contact portion 23*a* of the terminal. And, when a connector having the connector with the gel sticking to the electric contact portion 23*a* thereof in this manner is connected with its mating connector, there is a fear that the gel can enter between the contacts of their respective connecting pins to thereby cause poor conduction between the two connectors.

SUMMARY OF THE INVENTION

The present invention aims at eliminating the drawbacks found in the above-mentioned conventional connector structure. Accordingly, it is an object of the invention to provide a connector structure which, when a terminal passes through a gel, can keep the gel from sticking to the terminal to thereby prevent the conduction reliability of the connector structure from being lowered.

In attaining the above object, according to the invention as set forth in a first aspect, there is provided a connector structure arranged such that a plurality of terminal storage chambers respectively formed within a housing are in communication with the outside through their associated terminal insertion passages, a gel interposed between the terminal storage chambers and terminal insertion passages is disposed within the housing, a plurality of terminals respectively connected to the respective leading ends of their associated electric wires are respectively mounted within the terminal storage chambers in such a manner that the terminals are inserted from the terminal insertion passages and are made to pass through the gel, and the gel seals off spaces between the housing and electric wires, wherein, in the terminal insertion passages, there are respectively disposed leader bodies which are respectively so held at the respective leading ends of their associated ones of the terminals as to be able to pass through the gel and also which, after they have passed through the gel, can be discharged to the outside from their associated ones of the terminal storage chambers.

According to the present connector structure, when the terminal is inserted from the terminal insertion passage, the terminal thrusts through the gel, while the leader body held at the leading end of the terminal leads the terminal. Due to this, the gel is allowed to flow smoothly along the leading end of the terminal, thereby being able to prevent the gel from sticking to the leading end of the terminal.

Also, according to the invention as set forth in a second aspect, in the connector structure as set forth in the first aspect, the electric contact portion of each of the terminals is formed in a prismatic or cylindrical shape, the leading end face of each of the terminals is formed as a surface which intersects at right angles to the axis of the electric contact portion, and each of the leader bodies is formed as a globe-shaped body having a size which does not allow the leader body to advance into an opening formed in the leading end of the electric contact portion.

According to the present connector structure, since the leader body is a globe-shaped body, when assembling the present leader body to the terminal, there is eliminated the need for consideration of the direction of the leader body. Also, there can be always obtained a constant gel thrusting ability with no consideration of the direction of the leader body. Further, when compared with a case in which the leader body is formed in other shapes than the globular shape, the leader body can be discharged smoothly from the terminal storage chamber.

Further, according to the invention as set forth in a third aspect, in the connector structure as set forth in the first or second aspect, there are provided projections on the respective inner wall surfaces of the terminal insertion passages, and the leader bodies are respectively held by and between the present projections and gel.

According to the present connector structure, the leader body can be positively installed at a given position within the housing.

DETAILED DESCRIPTION OF PREFERRED EMBODIMENTS

Now, description will be given below in detail of a preferred embodiment of a connector structure according to the invention with reference to the accompanying drawings.

Figure 1:
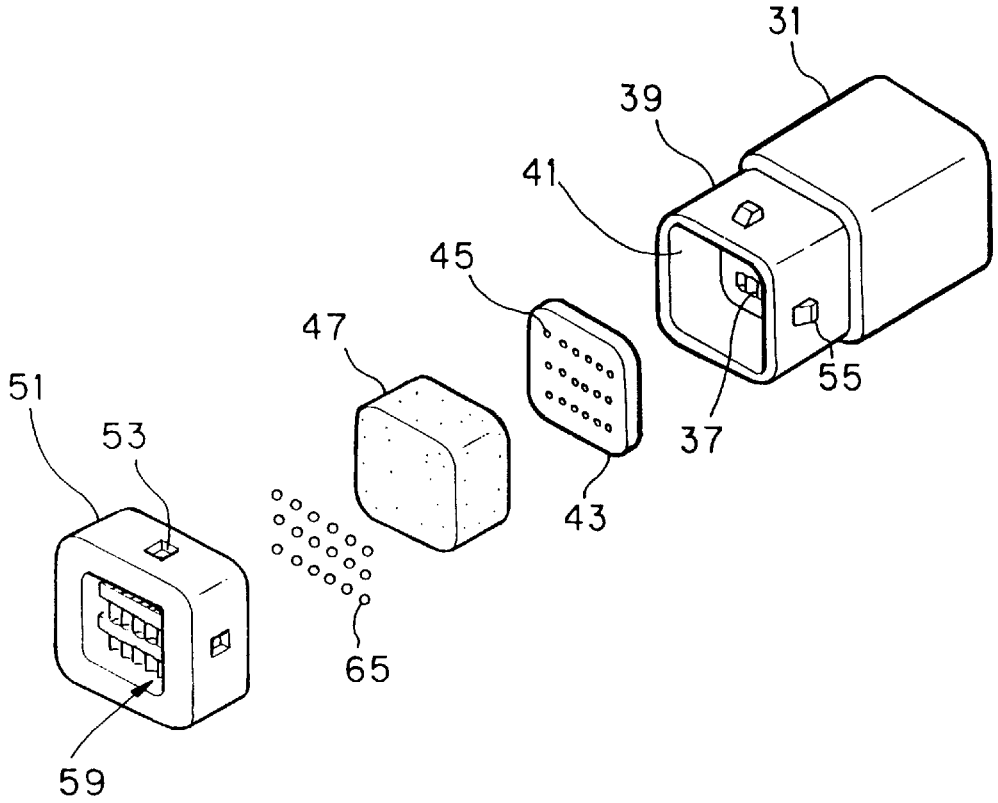
FIG. 1 is an exploded perspective view of a preferred embodiment of a connector structure according to the invention.
Figure 2:
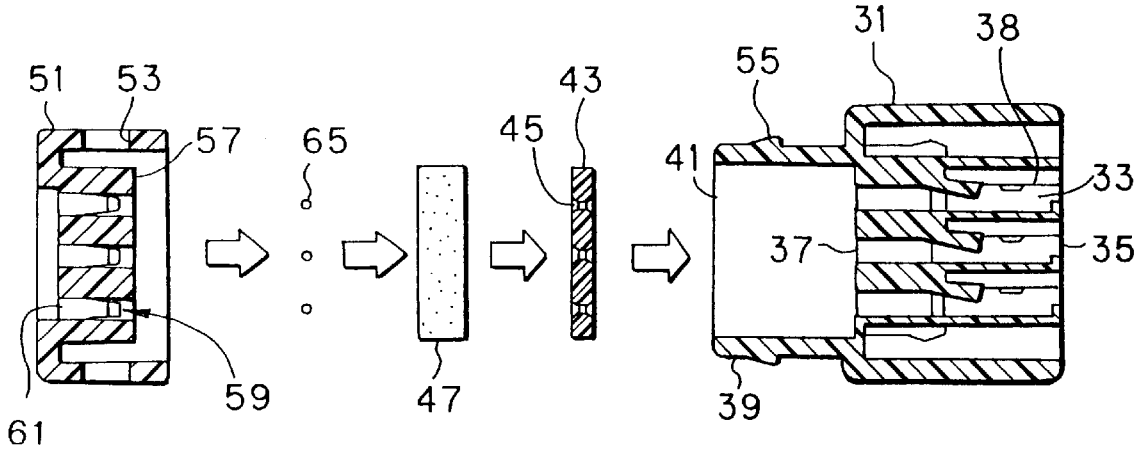
FIG. 2 is a longitudinal section view of the connector structure shown in FIG. 1.

In particular, FIG. 1 is an exploded perspective view of a preferred embodiment of a connector structure according to the invention, and FIG. 2 is a longitudinal section view of the connector structure shown in FIG. 1.

In a housing 31 which is formed of resin material, there are formed a plurality of matrix-shaped terminal storage chambers 33. The terminal storage chambers 33 respectively provide terminal access passages 35 and are opened in the front surface of the housing 31, while they also provide terminal insertion openings 37 and are opened in the rear surface of the housing 31. Also, within the housing 31, there are formed a plurality of leader body discharge holes 38. The leader body discharge holes 38 are respectively opened in the front surface of the housing 31 and allow their associated terminal storage chambers 33 to communicate with the outside. The leader body discharge holes 38 respectively provide passages from which their associated leader bodies (the details of which will be discussed later) can be discharged to the outside.

On the rear surfaces of the terminal insertion openings 37, there is projectingly provided a hood 39 which encloses all of the terminal insertion openings 37 therein and is opened at the rear end thereof. The internal space of the hood 39 provides a storage portion 41 for a gel (which will be discussed later). A plate-shaped packing 43 is also inserted into the storage portion 41. In the packing 43, there are formed a plurality of matrix-shaped through holes 45 which respectively correspond to the terminal insertion openings 37.

Into the storage portion 41 with the packing 43 stored therein, there is further inserted a mat seal member (that is, gel) 47. As the gel 47, for example, there can be used a silicone gel. The gel 47 is stored within the storage portion 41 in such a manner that the outer peripheral surface thereof is in close contact with the inner peripheral surface of the storage portion 41. Therefore, the terminal insertion openings 37 are respectively closed by the packing 43 and gel 47.

A rear holder 51 to be united integrally with the housing 31 is to be mounted onto the hood 39. The rear holder 51 includes a fitting portion in the front surface thereof, while the fitting portion is opened. In the peripheral wall of the rear holder 51, there are formed a plurality of securing holes 53. The securing holes 53, when the rear holder 51 is fitted with the hood 39 with a given depth, can be respectively engaged with their associated securing projections 55 provided on and projected from the outer periphery of the hood 39, thereby allowing the rear holder 51 to be secured to the hood 39.

In the inside of the rear holder 51, there is formed a gel pressing portion 57 which projects forwardly of the rear surface side of the rear holder 51 and can be inserted into the hood 39. The gel pressing portion 57 includes, at positions thereof corresponding to the terminal insertion openings 37, a plurality of matrix-shaped terminal insertion passages 59. Each of the terminal insertion passages 59, in particular, the two ends thereof are opened on the front surface of the gel pressing portion 57 and the rear surface of the rear holder 51, respectively.

Figure 3:
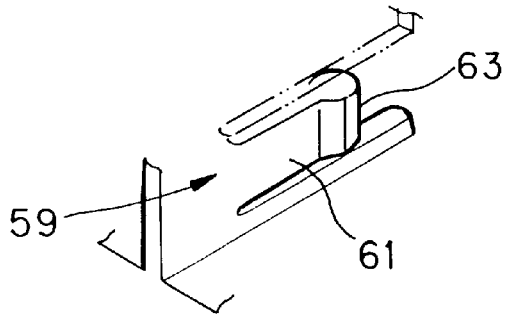
FIG. 3 is an enlarged perspective view of an arm portion formed in a housing employed in the present connector structure.

The mutually adjoining terminal insertion passages 59 are separated by a partition wall and, in part of the partition wall, there is disposed an arm portion 61. The arm portion 61, as shown in FIG. 3, is formed as an elastic piece the leading end of which is a free end. On the leading end of the arm portion 61, there is provided a projection 63 which expands out into its associated terminal insertion passage 59. Therefore, each terminal insertion passage 59 is narrowed by the projection 63 which projects from the opposing inner wall thereof.

Figure 4:
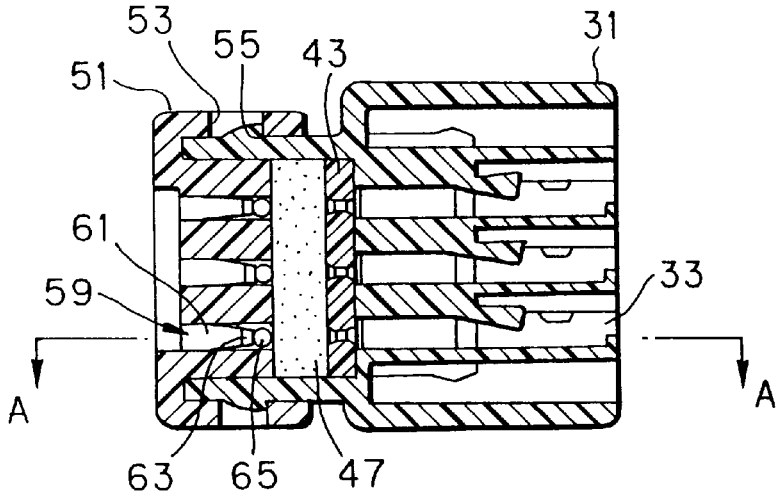
FIG. 4 is a section view of the connector structure according to the invention, showing its assembled state.
Figure 5:
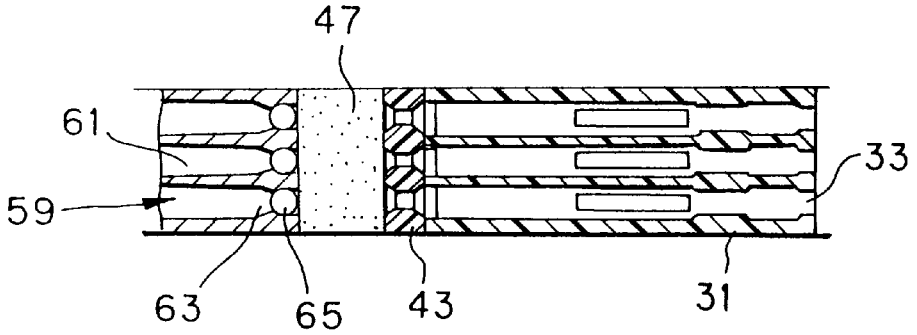
FIG. 5 is a section view taken along the line A—A shown in FIG. 4.

In front of the projections 63, there are respectively disposed leader bodies such as globe-shaped beads 65. Each bead 65 is formed such that it is smaller in size than the terminal insertion passage 59 but is larger than the narrowed passage width of the terminal insertion passage 59 that is narrowed by the projection 63. For example, if the gel pressing portion 57 is turned upward and is inserted into the upwardly-opened terminal insertion passage 59, then the bead 65 can be contacted with the projection 63 and thus can be held within the terminal insertion passage 59. In this state, if the hood 39 with the gel 47 stored therein is mounted on the rear holder 51 from the front surface opening thereof, then the bead 65, as shown in FIGS. 4 and 5, can be mounted into the housing 31 in such a manner that it is held by and between the projection 63 and gel 47.

Next, description will be given below of the operation of the thus constructed connector structure.

Figure 6:
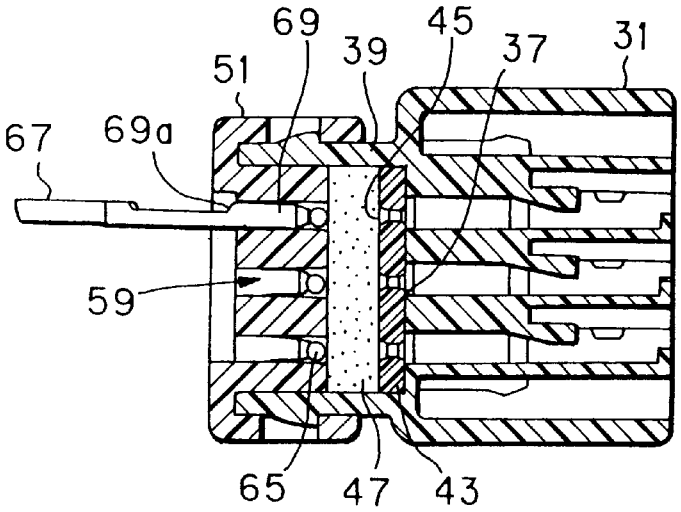
FIG. 6*a–c* is a section view of the connector structure according to the invention, showing a state thereof in which a terminal insertion process is illustrated step by step.
Figure 6:
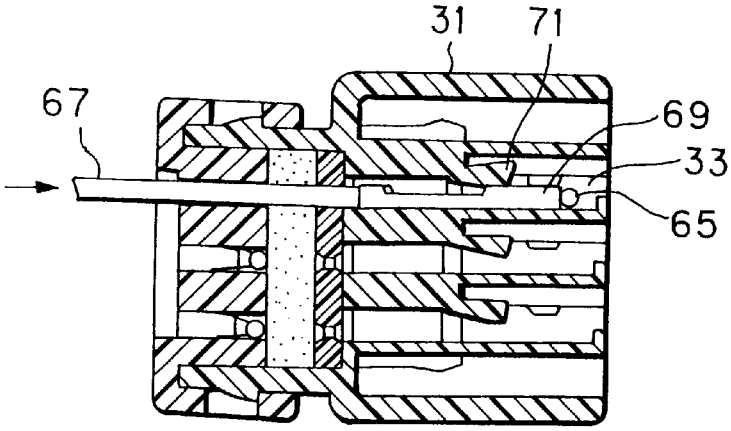
Figure 6:
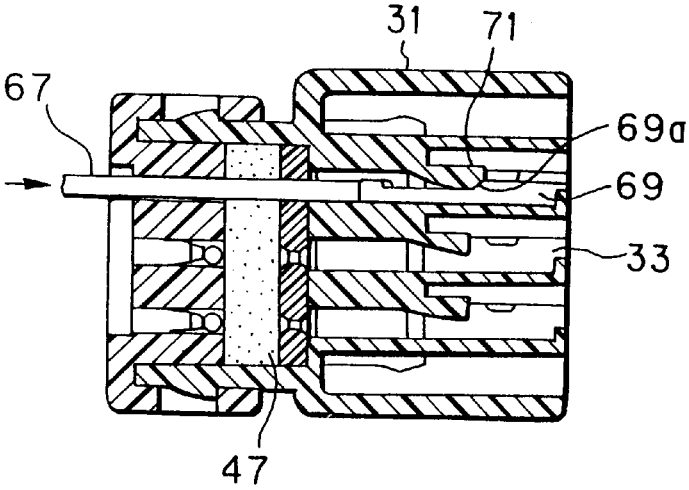
Figure 7:
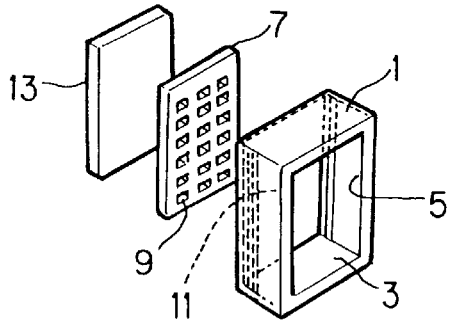
FIG. 7 PRIOR ART
FIG. 7 is an exploded perspective view of a rear holder portion formed in a conventional connector structure.
Figure 8:
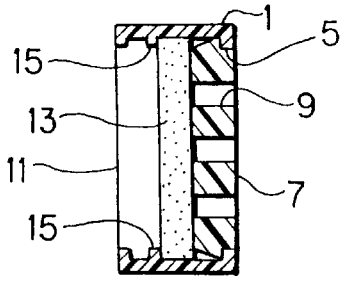
FIG. 8 PRIOR ART
FIG. 8 is a section view of a rear holder with a gel stored therein according to the conventional connector structure.
Figure 9:
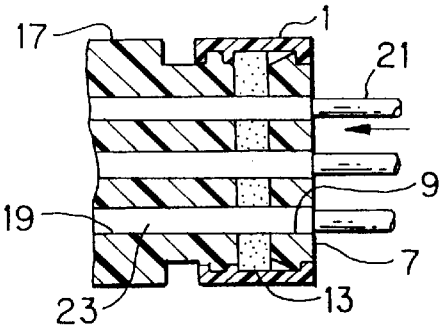
FIG. 9 PRIOR ART
FIG. 9 is a section view of the main portions of the conventional connector structure; and, FIG. 10 is a perspective view of an example of a terminal used in the conventional connector structure.

Here, FIG. 6 is a section view of a connector structure according to the invention, showing a terminal insertion process step by step.

As shown in FIG. 6 (*a*), the housing 31, in which the rear holder 51 is fitted with the hood 39 thereof, is held in such a state that the packing 43, gel 47 and beads 65 are sequentially interposed between the terminal insertion openings 37 and terminal insertion passages 59. In this state, a terminal 69 secured to an electric wire 67 is inserted into the housing 31 from the terminal insertion passage 59 which is opened on the rear surface of the rear holder 51.

Figure 10:
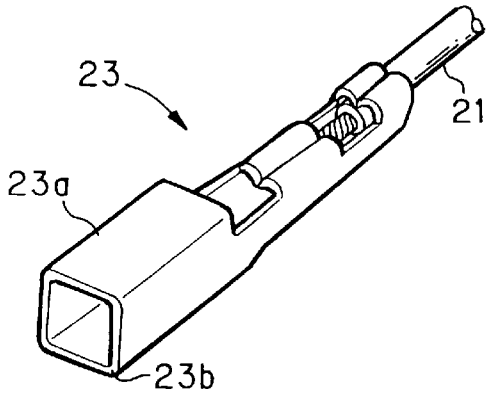
FIG. 10 PRIOR ART

As the terminal 69, for example, as shown in FIG. 10, there can be used a terminal in which an electric contact portion thereof is formed in a prismatic shape and the leading end of the electric contact portion is opened on a surface which intersects at right angles to the axis of the electric contact portion. If the terminal 69 is inserted into the terminal insertion passage 59, then the terminal 69 is contacted with the bead 65 which is held by and between the projection 63 and gel 47. Part of the bead 65 is fitted into the opening formed in the leading end of the terminal 69 and the bead 65 is thereby held at the leading end of the terminal 69.

If the terminal is further inserted, then the terminal 69, with the bead 65 as the leader thereof, passes through the gel 47 while thrusting through the gel 47 and advances into the terminal storage chamber 33 from the terminal insertion opening 37.

And, as shown in FIG. 6 (*b*), the terminal 69 reaches a position where it is able to flex an elastic securing piece 71 disposed within the terminal storage chamber 33. At the then time, the holding of the bead 65 from the forward side thereof, which has been held at the leading end of the terminal 69, is removed and thus the bead 65 falls down into the terminal storage chamber 33. The bead 65 fallen down into the terminal storage chamber 33 is discharged externally of the housing 31 through the leader body discharge hole 38.

Further, as shown in FIG. 6 (*c*), if the terminal 69 is inserted still further, then the securing portion of the elastic securing piece 71 is engaged with a securing stepped portion formed in the terminal 69, thereby being able to restrict removal of the terminal 69 from the terminal storage chamber 33. Also, in this state, the gel 47 is closely contacted with the outer periphery of the electric wire 67, thereby being able to seal off watertight a space between the housing 31 and electric wire 67.

Through the above-mentioned terminal insertion process, the mounting of the terminal 69 into the housing 31 can be completed.

In this manner, in the above-mentioned connector structure, due to provision of the bead 65 on the terminal insertion passage 59 side of the gel 47 stored within the housing 31, when the terminal 69 is inserted from the terminal insertion passage 59, the terminal 69, with the bead 65 as the leader thereof, thrusts through the gel 47. Therefore, it is possible to prevent sticking of the gel 47 to the terminal 69 which is liable to occur when the terminal 69 thrusts directly through the gel 47.

And, since the leader body is formed as the globe-shaped bead 65, there is eliminated the need for consideration of the direction of the leader body when the leader body is assembled to the terminal 69, which not only can enhance the efficiency of the assembling operation but also can always provide a constant gel thrusting ability. Further, when compared with a case in which the leader body is formed in other shapes than the globe shape, the globe-shaped leader body can be smoothly discharged from the terminal storage chamber 33.

By the way, in a connector structure according to the invention, the packing 43 may be omitted according to cases.

Also, in order to enhance the gel 47 thrusting ability thereof, the leader body can be formed in other shapes than the above-mentioned globe shape, for example, a globular body having an elliptic section, a conical-shaped body, or the like. In this case, the leader body is able to thrust through the gel 47 with a weaker insertion force, which makes it possible to enhance the efficiency of the terminal inserting operation.

Further, in the illustrated embodiment, description has been given on the assumption that the terminal is female terminal formed in a prismatic shape. However, the invention is not limited to this but, for example, the terminal may be a cylindrical-shaped one, or a pin-shaped male terminal. In this case, if there is formed in the leader body a recessed portion or the like which can be engaged with the leading end portion of the pin-shaped terminal, then the holdability of the leader body can be enhanced.

As has been described heretofore in detail, in a connector structure according to the invention, since the leader body is provided on the terminal insertion passage side of the gel stored within the housing, when the terminal is inserted from the terminal insertion passage, the terminal, while it is headed by the leader body held at the leading end of the terminal, thrusts through the gel. Due to this, it is possible to prevent sticking of the gel to the terminal which is liable to occur when the terminal thrusts directly through the gel with its own leading end, it is possible to prevent lowering of the conduction reliability of the terminal caused by sticking of the gel to the terminal.

What is claimed is:

1. A connector structure comprising:

a housing:

a plurality of terminal storage chambers respectively formed within said housing, said terminal storage chambers being in communication with an outside through their associated terminal insertion passages;

a gel interposed between said terminal storage chambers and said terminal insertion passages being disposed within said housing;

a plurality of terminals respectively connected to the respective leading ends of their associated electric wires, said terminals being respectively mounted within said terminal storage chambers in such a manner that said terminals are inserted from said terminal insertion passages and are made to pass through said gel, and said gel seals off spaces between said housing and said electric wires; and a plurality of leader bodies respectively held in said terminal insertion passages at the respective leading ends of their associated ones of said terminals as to pass through said gel, after said leader bodies have passed through said gel, said leader bodies being discharged to the outside from their associated ones of said terminal storage chambers.

2. A connector structure as set forth in claim 1, wherein the electric contact portion of each of said terminals is formed in one of a prismatic and cylindrical shape, the leading end face of each of said terminals is formed as a surface which intersects at right angles to the axis of said electric contact portion, and each of said leader bodies is formed as a globe-shaped body having a size which avoids to allow said leader body to advance into an opening formed in the leading end of said electric contact portion.

3. A connector structure as set forth in claim 1, wherein projections are provided on the respective inner wall surfaces of said terminal insertion passages, and said leader bodies are respectively held by and between said projections and said gel.

4. A connector structure as set forth in claim 2, wherein projections are provided on the respective inner wall surfaces of said terminal insertion passages, and said leader bodies are respectively held by and between said projections and said gel.

* * * * *